United States Patent [19]

Skinner et al.

[11] Patent Number: 5,071,321

[45] Date of Patent: Dec. 10, 1991

[54] VARIABLE DISPLACEMENT REFRIGERANT COMPRESSOR PASSIVE DESTROKER

[75] Inventors: Timothy J. Skinner, E. Amherst; Joseph L. Spurney, Rochester; Timothy S. Jones, Lockport, all of N.Y.

[73] Assignee: General Motors Corporation, Detroit, Mich.

[21] Appl. No.: 637,260

[22] Filed: Jan. 3, 1991

Related U.S. Application Data

[63] Continuation-in-part of Ser. No. 417,955, Oct. 2, 1989.

[51] Int. Cl.[5] ..... F04B 1/26

[52] U.S. Cl. ..... 417/222 S; 417/270

[58] Field of Search ..... 417/222, 222 S, 270

[56] References Cited

U.S. PATENT DOCUMENTS

| | | | |
|---|---|---|---|
| 3,659,783 | 5/1972 | Schwartz | 236/93 |
| 4,480,964 | 11/1984 | Skinner | 417/222 |
| 4,560,105 | 12/1985 | Jiandani | 236/58 |
| 4,606,705 | 12/1985 | Jiandani | 236/58 |
| 4,616,778 | 10/1986 | Thieme | 236/58 |
| 4,679,727 | 7/1987 | Alesson | 236/56 |
| 4,747,753 | 5/1988 | Taguchi | 417/222 |
| 4,778,348 | 10/1988 | Kikuchi et al. | 417/222 |
| 4,780,060 | 10/1988 | Terauchi | 417/222 |
| 4,872,814 | 10/1989 | Skinner et al. | 417/222 |

FOREIGN PATENT DOCUMENTS 62-87680 4/1987 Japan .

*Primary Examiner*—Richard A. Bertsch
*Assistant Examiner*—Peter Korytnyk
*Attorney, Agent, or Firm*—Ronald L. Phillips

[57] ABSTRACT

The bellows in the stroke control valve of a variable stroke axial piston wobble plate refrigerant compressor is partially filled with an anti-freeze solution and continuously exposed to both suction pressure and crankcase pressure. This has the effect of reducing the piston stroke at high compressor speeds while increasing suction pressure to maintain some air conditioning performance.

14 Claims, 3 Drawing Sheets

VARIABLE DISPLACEMENT REFRIGERANT COMPRESSOR PASSIVE DESTROKER

This is a continuation-in-part of U.S. application Serial No. 07/417,955 filed Oct. 2, 1989.

TECHNICAL FIELD

This invention relates to compressors that are driven at varying speed and have a variable displacement that is controlled by a valve arrangement responsive to at least suction pressure. More particularly, this invention relates to reducing the displacement at high speeds for improved durability.

BACKGROUND OF THE INVENTION

In variable displacement refrigerant compressors such as those of the variable angle wobble plate type used in motor vehicle air conditioning systems, it has been found desirable for extended compressor life expectancy to destroke to reduce the compressor displacement at high speed operation. Current practice with compressors of the above type is to control stroke with a suction pressure sensitive control valve which utilizes an evacuated bellows to regulate the pressure difference on the compressor pistons creating a force to move the wobble plate mechanism to the controlled stroke condition. The controlled stroke or displacement condition will under most operating conditions maintain the low side refrigerant pressure at a value that results in approximately maximum potential cooling performance with no risk of evaporator icing. A limitation of this concept is that this control criteria will, under high operating speed and air conditioning load conditions, result in a relatively high mechanism stroke condition that produces high mechanism inertial loads and lowers durability. The operating time at these high speed conditions is low and in turn the need for maximum air conditioning cooling is not priority over maintaining acceptable durability. In some cases in current practice the compressor is turned off via clutch disengagement at high speed conditions—a situation which protects the compressor but results in no cooling potential for the vehicle.

One proposed solution to the above problem is to add a solenoid valve that operates above a prescribed compressor speed to control a conventional stroke control valve so as to increase the crankcase pressure to discharge pressure to thereby effect minimum piston stroke and thereby minimum displacement to prolong compressor life. This proposal is disclosed in U.S Pat. No. 4,606,705 assigned to the assignee of the present invention.

A more desirable solution is a passive type destroker that would reduce the compressor displacement during certain high speed operation to improve the durability of the compressor mechanism while maintaining some compressor displacement and thereby air conditioning potential. Such a passive destroker is disclosed in U.S. Pat. application Ser. No. 204,338 filed June 9, 1988, and assigned to the assignee of the present invention. This device comprises a centrifugal destroke valve mechanism that is connected in parallel with a conventional stroke control valve arrangement and mechanically attached onto the compressor shaft so as to both slide and rotate in contact with an existing compressor part (i.e. the suction reed disk). The passive destroke mechanism includes a counterweighted valve member that rotates with the compressor shaft and at a predetermined trigger speed develops a centrifugal force that overrides a spring and friction force to slide the valve member from a closed to an open position. In the open position, a flow path is created between the discharge or high pressure side of the compressor and the crankcase to thereby allow a controlled discharge gas to bleed into the crankcase to destroke the compressor to a desired low displacement with the control effect accomplished by close control of the size of the delivery port. On the other hand, when the speed of the compressor is eventually reduced to the trigger speed, the centrifugal force is thereby reduced and overridden by the spring force so that the valve member then slides back towards its normal closed position wherein the compressor then operates as normal under the conventional stroke control valve arrangement. While this device has proven generally satisfactory, there remains a desire for a simpler and more durable passive destroker that can be incorporated in existing compressors with only minor modifications.

SUMMARY OF THE INVENTION

According to the present invention, a characteristic is added to the conventional displacement control valve which senses the high speed condition and causes the compressor to destroke and assume a much more durable condition but at the same time continue pumping at a reduced level to maintain a minimum cooling level. The concept utilized comes from the discovery that the operating temperature of the compressor increases, due to reduced compressor mechanical efficiency, as the compressor's rotational speed increases. FIG. 2 of the accompanying drawing displays this characteristic graphically in showing the internal compressor crankcase temperature and control valve bellows temperature versus speed wherein it will be seen that these temperatures essentially parallel each other while increasing with increasing compressor speed. The temperature versus speed characteristic of the bellows is utilized for high speed destroking by simply adding a fluid inside the suction pressure biased and heretofore normally evacuated control valve bellows which results in an increase in internal bellows pressure, due to increasing vapor pressure of the fluid at high operating speeds, that offsets the normal control characteristic of the control valve. The fluid, which may be a liquid, vapor and/or gas, is selected so that the resulting gas pressure inside the bellows effectively shifts the setting or control pressure higher as the temperature increases so as to have the effect of significantly reducing the stroke of the mechanism 20–50% that of the conventional control resulting in over a 100% increase in operating time without difficulty at high operating speeds. In turn, the suction pressure increases 8–12 psi which will maintain the air conditioning system at a condition where some air conditioning performance is realized. Because of the nature of operation, the device of the present invention is suitably termed a "thermal destroker" herein.

It is therefore an object of the present invention to provide a new and improved speed responsive destroker for a variable displacement refrigerant compressor.

Another object is to provide in a variable stroke axial piston wobble plate compressor a passive thermal destroker that responds to crankcase temperature to control the pressure in the crankcase to lower the stroke above a certain compressor temperature (speed).

Another object is to provide in a variable displacement refrigerant compressor having a conventional stroke control valve arrangement that controls displacement and wherein such valve includes a suction pressure biased bellows, a thermal destroker formed by the addition of a fluid including liquid, vapor and/or gas to the bellows that operates in response to increasing crankcase temperature to effectively raise the valve control setting for decreased displacement.

Another object is to provide a thermal destroker for a variable stroke axial piston wobble plate refrigerant compressor by the addition of a liquid to the normally evacuated bellows of a conventional pressure biased stroke control valve thereby to effect offsetting of the normal control by the valve so as to reduce the stroke with increasing crankcase temperature above a certain compressor speed.

These and other objects, advantages and features of the present invention will become more apparent from the following description and drawing in which:

DETAILED DESCRIPTION OF THE PREFERRED EMBODIMENT

Figure 1:
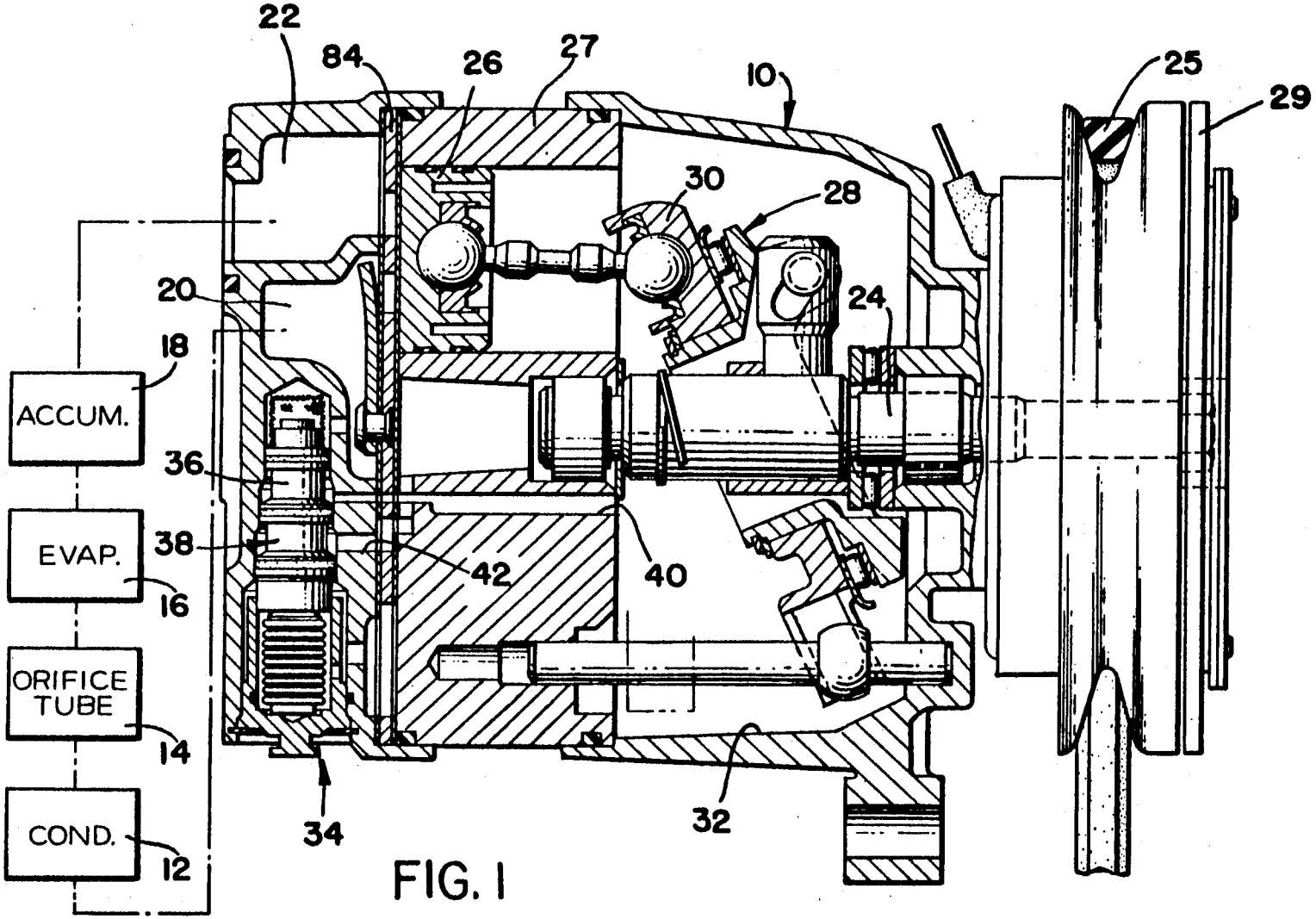
FIG. 1 is a cross-sectional view of a variable displacement refrigerant compressor of the variable angle wobble plate type having incorporated therein a preferred embodiment of the passive thermal destroker according to the present invention. This figure further includes a schematic of a motor vehicle air conditioning system in which the compressor is connected.

Referring to FIG. 1, there is shown a variable displacement refrigerant compressor 10 of the variable angle wobble plate type connected in a motor vehicle air conditioning system having the normal condenser 12, orifice tube 14, evaporator 16 and accumulator 18 arranged in that order between the compressor's discharge cavity 20 and suction cavity 22.

The compressor has a drive shaft 24 driven at varying speed by the vehicle's engine (not shown) through a drive belt 25 and the operation of an electromagnetic clutch 29. Five pistons 26, (only one being shown) mounted in the compressor's cylinder block 27 are connected to be driven by the shaft through a tiltable wobble plate mechanism 28. The stroke of the pistons and thereby the displacement of the compressor is determined by the operating angle of this mechanism whose wobble plate 30 is made to angulate by pressurizing the sealed crankcase 32 using the refrigerant discharge pressure and controlling the pressure in the crankcase relative to suction pressure with a displacement control valve arrangement 34. The control valve arrangement 34 comprises a stroke decrease control valve means 36 and a stroke increase control valve means 38 that are responsive to both discharge pressure and suction pressure such as to communicate the crankcase with the respective discharge and suction cavities 20 and 22 via a crankcase charge passage 40 and crankcase bleed passage 42, respectively, to increase the piston stroke and thereby displacement and discharge flow rate with both increasing suction and discharge pressures.

The details of the compressor 10 thus far described are like that disclosed in U.S. Pat. No. 4,428,718 assigned to the assignee of the present invention and which is hereby incorporated by reference. However, it is also contemplated that the displacement control valve arrangement might also take the form of entirely separate valves and also an electronic control valve responsive to suction and/or discharge pressure and other parameters such as temperature and speed affecting the air conditioning conditions and requirements.

To clearly understand the present invention, the skilled person needs to understand that in the valve arrangement 34 the stroke control is effected in part by a sealed bellows 44 that is externally exposed to suction pressure. Heretofore, the bellows 44 was normally evacuated of all fluid so as to expand in response to decreasing suction pressure and thereby produce a force urging the valve means 38 to close the crankcase bleed passage 42. At the same time, the discharge pressure produces an opposing force through the other valve means 36 with the latter simultaneously urged to close the crankcase charge passage 40. These variable pressure biases are in addition to the biases of the springs 46, 48 and 50 which act to normally condition the control valve arrangement so as to close the crankcase charge passage and simultaneously open the crankcase bleed passage to thereby normally effect maximum compressor displacement by establishing zero crankcase-suction pressure differential.

The objective is to match the compressor displacement with the air conditioning demand under all conditions so that the evaporator is kept just above the freezing temperature (pressure) without cycling the compressor on and off with the clutch 29 and with the optimum being to maintain as cold an evaporator as can be achieved at higher ambients without evaporator freeze and as high an evaporator temperature at lower ambients as can be maintained while still supplying some dehumidification. To this end, the control point for the control valve arrangement determining displacement change is selected so that when the air conditioning capacity demand is high, the suction pressure at the compressor after the pressure drop from the evaporator will be above the control point (e.g. 170–210 kPa).

The control valve arrangement is calibrated at assembly at the bellows and with the spring biases so that the then existing discharge-suction pressure differential acting on the control valve arrangement is sufficiently high to maintain same in the condition shown closing the crankcase charge passage and opening the crankcase bleed passage. The control valve arrangement will then maintain a bleed from the crankcase to suction while simultaneously closing off discharge pressure thereto so that no crankcase-suction pressure differential is developed and, as a result, the wobble plate will remain in its maximum angle position shown in solid line in FIG. 1 to provide maximum compressor displacement. Then when the air conditioning capacity demand reduces and the suction pressure reaches the control point, the resulting change in the discharge-suction pressure differential acting on the control valve arrangement will condition its valving to then open the crankcase charge passage and simultaneously close the crankcase bleed and thereby elevate the crankcase-suction pressure differential.

The angle of the wobble plate is controlled by a force balance on the pistons so only a slight elevation (e.g. 40–100 kPa) of the crankcase-suction pressure is effective to create a net force on the pistons that results in a moment about the wobble plate pivot axis that reduces the wobble plate angle and thereby the compressor displacement. Moreover, in that the control valve bellows, in addition to being acted on by the suction control pressure, has to also overcome discharge pressure in expanding to elevate the crankcase-suction pressure differential to reduce compressor displacement, the displacement change control point is thus depressed with increasing discharge pressure (higher ambients). In that the refrigerant flow rate, and in turn suction line pressure drop, increases with increasing discharge pressure (higher ambients) the control valve depresses the control point in proportion to the discharge pressure and likewise suction line pressure drop. This compressor displacement compensating feature permits controlling at the compressor suction while maintaining a nearly constant evaporator pressure (temperature) above freezing which has been found to result in substantially better high load performance and reduced power consumption at low ambients on a yearly basis.

Figure 3:
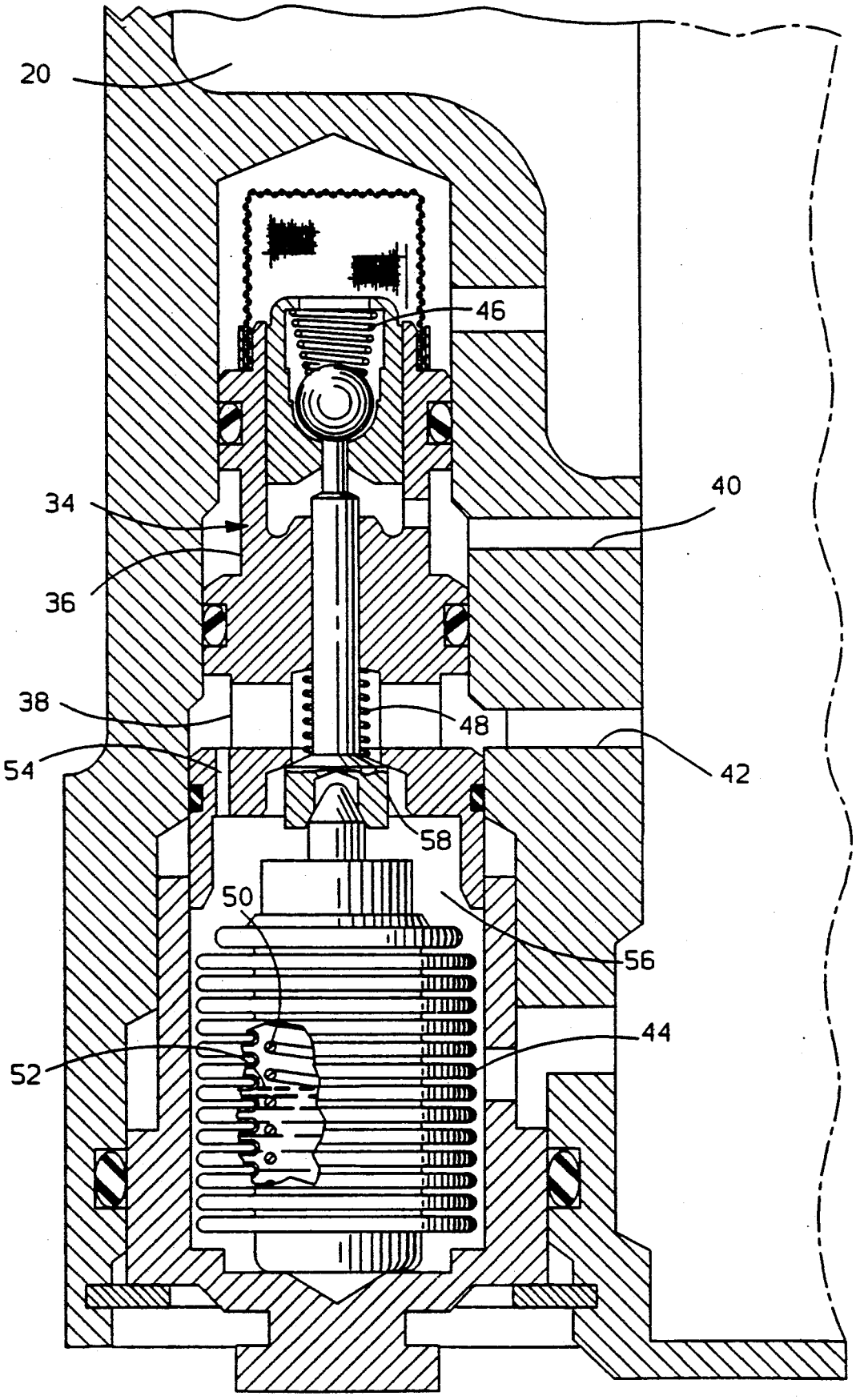
FIG. 3 is an enlarged view with parts broken away of the bellows in FIG. 1.

According to the present invention, the bellows 44, instead of being evacuated of all fluid, is partially filled with an anti-freeze solution 52 after evacuation of the air. See FIG. 3. For example, a mixture of 70% glycol and 30% water by volume or a solvent such as alcohol with similar vapor pressure about 50% of the bellows volume was found to work satisfactorily in reducing the piston stroke by the desired amount at high compressor speeds. And there is also added a bleed orifice 54 in the valve arrangement 34 continuously connecting the crankcase 32 via the passage 42 to the chamber 56 containing the bellows. In that the sealed and charged expansible chamber means (bellows 44) is located in the flow path from the crankcase to suction cavity, it is directly exposed to crankcase gas and hence temperature. As seen in FIG. 3, the valve needle head 58 creates the flow restriction from the crankcase and hence defines the location in this flow path where crankcase pressure is established. The bleed orifice 54 is located in the decrease control valve 38 in a manner to assure that a minimum flow exists from crankcase to suction at all positions of this valve and thereby assure that there is always a crankcase gas temperature influence on the bellows.

In that the bellows is downstream in the flow path from the needle head 58 (flow restriction), the pressure in the chamber 56 surrounding the bellows area is that of the primary refrigerant suction pressure. This is assured by design in sizing the passage to suction cavity substantially larger than the sum of the crankcase to suction flow restriction and the fixed bleed. As a result of the above factors, the control valve bellows is responsive to both the gas temperature in the crankcase and the primary suction pressure.

Figure 2:
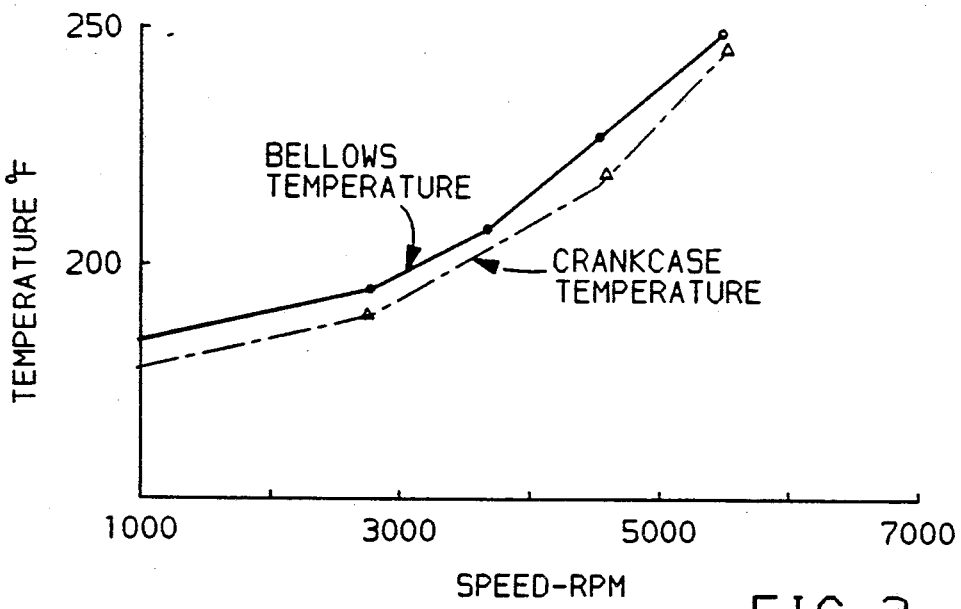
FIG. 2 is a graph showing the temperatures of the bellows and crankcase in FIG. 1 plotted against the compressor's shaft speed.
Figure 4:
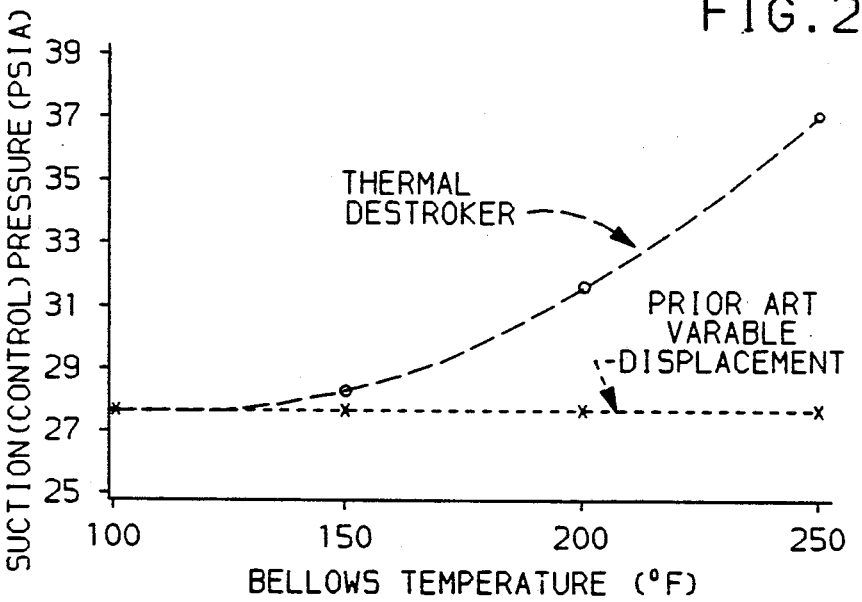
FIG. 4 is a graph showing the suction pressure of the compressor in FIG. 1 plotted against the temperature of the bellows with and without the addition of liquid.
Figure 5:
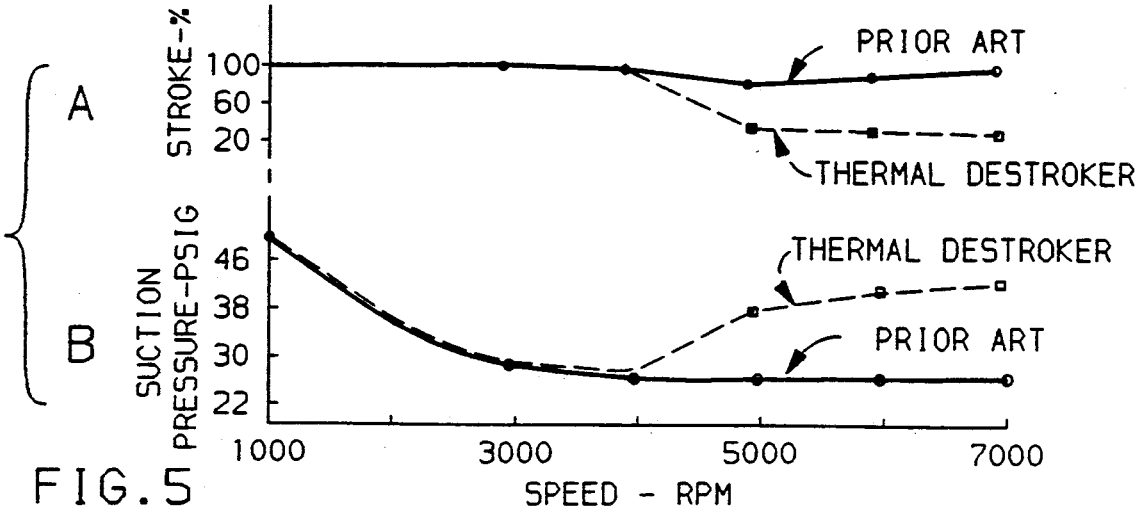
FIG. 5 is a graph showing the piston stroke and suction pressure of the compressor in FIG. 1 plotted against the compressor shaft speed with and without the addition of liquid to the bellows.

As earlier related, the bellows temperature increases with increasing compressor speed (FIG. 2) and thus with the above addition of liquid in the bellows and the bleed orifice 54 there results an increase in internal bellows pressure due to increasing vapor pressure. This internal bellows pressure increase has the effect of offsetting the normal control characteristics of the control valve arrangement 34 just at high operating speeds so as to then modulate the crankcase pressure to significantly reduce the stroke while maintaining some air conditioning performance. These effects are shown graphically in FIGS. 4 and 5. As seen in FIG. 4, the gas pressure in the bellows acts to shift the suction (control) pressure higher as the temperature increases. FIG. 5 shows the resultant effect on displacement control in that the piston stroke of the wobble plate mechanism is reduced above a compressor speed of 4000 rpm about 20–50% over the prior art control (completely evacuated bellows) which results in over a 100% increase in operating time without mechanism difficulty at high operating speeds. In addition, the suction pressure in turn increases about 8–12 psi above 4000 rpm as also shown in FIG. 5 which has the effect of maintaining the air conditioning system in a condition where some significant performance is realized. Moreover, it is seen that the destroking and suction pressure increase is initially dramatic in that their departure from conventional is at an accelerating rate (decreasing and increasing respectively with increasing speed) up to about 5000 rpm whereafter they essentially level out at higher speeds (i.e. to 7000 rpm). This initial rapid change is advantageous in assuring that the maximum destroking is rapidly accomplished before a critical speed is reached. And thus the valve arrangement 34 functions at high compressor speeds in response to high crankcase gas temperatures to decrease displacement while maintaining acceptable displacement control, based on suction pressure, at lower speeds.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. For example, it should be understood that other fluids such as a liquid/vapor mixture, vapor or gas could be used that would perform as well if not better. Moreover, the invention may be applied to other forms of variable displacement refrigerant compressors as well as other forms of displacement control valves in addition to those that regulate crankcase to suction flow and/or discharge to crankcase flow to control stroke.

The embodiments of the invention in which an exclusive property or privilege is claimed are defined as follows:

1. In a variable displacement refrigerant compressor having a crankcase and a displacement control valve arrangement operable to control gas pressure in the crankcase by communicating compressor discharge and suction pressure therewith so as to increase the compressor's displacement with increasing suction pressure: the improvement comprising sealed chamber means incorporated in said valve arrangement partially filled with a fluid and continuously exposed to both the suction pressure and crankcase pressure to suction gas flow so as to be responsive to both the suction pressure and the gas temperature in the crankcase and thereby compressor speed for producing a valve control force in the valve arrangement that is effective to decrease the displacement above a certain compressor speed while maintaining acceptable displacement control at lower speeds.

2. In a variable displacement refrigerant compressor having a crankcase and a displacement control valve arrangement operable to control gas pressure in the crankcase by communicating compressor discharge and suction pressure therewith so as to increase the compressor's displacement with increasing suction pressure and discharge pressure: the improvement comprising sealed chamber means incorporated in said valve arrangement partially filled with a fluid and continuously exposed to both the suction pressure and crankcase to suction gas flow so as to be responsive to both the suction pressure and the gas temperature in the crankcase and thereby compressor speed for producing a valve control force in the valve arrangement that is effective to decrease the displacement above a certain compressor speed while maintaining acceptable displacement control at lower speeds.

3. In a variable displacement refrigerant compressor having a crankcase and a displacement control valve arrangement operable to control gas pressure in the crankcase by communicating compressor discharge and suction pressure therewith so as to increase the compressor's displacement with increasing suction pressure: the improvement comprising sealed chamber means incorporated in said valve arrangement partially filled with an anti-freeze solution and continuously exposed to both the suction pressure and crankcase pressure so as to be responsive to both the suction pressure and the gas temperature in the crankcase and thereby compressor speed for producing a valve control force in the valve arrangement that is effective to decrease the displacement above a certain compressor speed while increasing the suction pressure and maintaining acceptable displacement control at lower speeds.

4. In a variable displacement refrigerant compressor having a crankcase and a displacement control valve arrangement operable to control gas pressure in the crankcase by communicating compressor discharge and suction pressure therewith so as to increase the compressor's displacement with increasing suction pressure: the improvement comprising sealed bellow means incorporated in said valve arrangement partially filled with an anti-freeze solution and evacuated of air and continuously exposed to both the suction pressure and crankcase to suction gas flow so as to be responsive to both the suction pressure and the gas temperature in the crankcase and thereby compressor speed for producing a valve control force in the valve arrangement that is effective to decrease the displacement above a certain compressor speed while increasing the suction pressure and maintaining acceptable displacement control at lower speeds.

5. In a variable displacement refrigerant compressor having a crankcase and a displacement control valve arrangement operable to control gas pressure in the crankcase by communicating compressor discharge and suction pressure therewith so as to increase the compressor's displacement with increasing suction pressure: the improvement comprising sealed chamber means incorporated in said valve arrangement partially filled with an anti-freeze solution and continuously exposed to both the suction to suction gas flow and crankcase pressure so as to be responsive to both the suction pressure and the gas temperature in the crankcase and thereby compressor speed for producing a valve control force in the valve arrangement that is effective to decrease the displacement above a certain compressor speed while increasing the suction pressure and maintaining acceptable displacement control at lower speeds, said anti-freeze solution comprising a mixture of about 70% glycol and 30% water by volume and occupying about 50% of the volume of the chamber means.

6. A compressor as set forth in claim 5 wherein the chamber means is evacuated of air and a bleed orifice in the valve arrangement continuously communicates the crankcase with the chamber means.

7. In a variable displacement refrigerant compressor having a crankcase and a displacement control valve arrangement operable to control gas pressure in the crankcase by communicating compressor discharge and suction pressure therewith so as to increase the compressor's displacement with increasing suction pressure: the improvement comprising sealed chamber means incorporated in said valve arrangement partially filled with an anti-freeze solution and evacuated of air and continuously exposed, to both the suction pressure and crankcase to suction gas flow so as to be responsive to both the suction pressure and compressor temperature and thereby compressor speed for producing a valve control force in the valve arrangement that is effective to decrease the displacement above a certain compressor speed while increasing the suction pressure and maintaining acceptable displacement control at lower speeds.

8. In a variable displacement pivotal wobble plate refrigerant compressor having a crankcase and a stroke control valve arrangement operable in response to at least the compressor's suction pressure to control the crankcase gas pressure relative to the suction pressure so as to thereby increase the compressor's piston stroke with increasing suction pressure: the improvement comprising sealed chamber means incorporated in said valve arrangement partially filled with a fluid and continuously exposed to both the suction pressure and crankcase to suction gas flow so as to be responsive to both the suction pressure and the gas temperature in the crankcase and thereby compressor speed for producing a valve control force in the valve arrangement that is effective to modulate the crankcase pressure so as to decrease the piston stroke above a certain compressor speed and maintaining acceptable displacement control at lower speeds.

9. In a variable displacement pivotal wobble plate refrigerant compressor having a crankcase and a stroke control valve arrangement operable in response to the compressor's suction pressure and discharge pressure to control the crankcase pressure relative to the suction pressure so as to thereby increase the compressor's piston stroke with increasing suction and discharge pressure: the improvement comprising sealed chamber means incorporated in said valve arrangement partially filled with a fluid and continuously exposed to both the suction pressure and crankcase to suction gas flow so as to be responsive both the suction pressure and the gas temperature in the crankcase and thereby compressor speed for producing a valve control force in the valve arrangement that is effective to modulate the crankcase pressure so as to decrease the piston stroke above a certain compressor speed and maintaining acceptable displacement control at lower speeds.

10. In a variable displacement pivotal wobble plate refrigerant compressor having a crankcase and a stroke control valve arrangement operable in response to at least the compressor's suction pressure to control the crankcase pressure relative to the suction pressure so as to thereby increase the compressor's piston stroke with increasing suction pressure: the improvement comprising sealed chamber means incorporated in said valve arrangement partially filled with an anti-freeze solution and continuously exposed to both the suction pressure and crankcase to suction gas flow so as to be responsive to both the suction pressure and the gas temperature in the crankcase and thereby compressor speed for producing a valve control force in the valve arrangement that is effective to modulate the crankcase pressure so as to decrease the piston stroke above a certain compressor speed while increasing the suction pressure and maintaining acceptable displacement control at lower speeds.

11. In a variable displacement pivotal wobble plate refrigerant compressor having a crankcase and a stroke control valve arrangement operable in response to at least the compressor's suction pressure to control the crankcase pressure relative to the suction pressure so as to thereby increase the compressor's piston stroke with increasing suction pressure: the improvement comprising sealed bellow means incorporated in said valve arrangement partially filled with an anti-freeze solution and evacuated of air and continuously exposed to both the suction pressure and crankcase to suction gas flow as to be responsive to both the suction pressure and the gas temperature in the crankcase and thereby compressor speed for producing a valve control force in the valve arrangement that is effective to modulate the crankcase pressure so as to decrease the piston stroke above a certain compressor speed while increasing the suction pressure and maintaining acceptable displacement control at lower speeds.

12. In a variable displacement pivotal wobble plate refrigerant compressor having a crankcase and a stroke control valve arrangement operable in response to at least the compressor's suction pressure to control the crankcase pressure relative to the suction pressure so as to thereby increase the compressor's piston stroke with increasing suction pressure: the comprising sealed chamber means incorporated in said valve arrangement partially filled with an anti-freeze solution and responsive to both the suction pressure and compressor temperature and thereby compressor speed for producing a valve control force in the valve arrangement that is effective to modulate the crankcase pressure so as to decrease the piston stroke above a certain compressor speed while increasing the suction pressure and maintaining acceptable displacement control at lower speeds, said anti-freeze solution comprising a mixture of about 70% glycol and 30% water by volume and occupying about 50% of the volume of the chamber means.

13. A compressor as set forth in claim 12 wherein the chamber means is evacuated of air and a bleed orifice in the valve arrangement continuously communicates the crankcase with the chamber means.

14. In a variable displacement pivotal wobble plate refrigerant compressor having a crankcase and a stroke control valve arrangement operable in response to the compressor's suction pressure and discharge pressure to control the crankcase to suction gas flow relative to the suction pressure so as to thereby increase the compressor's piston stroke with increasing suction pressure: the improvement comprising sealed chamber means incorporated in said valve arrangement partially filled with an anti-freeze solution and evacuated of air and continuously exposed to both the suction pressure and crankcase to suction gas flow so as to be responsive to both the suction pressure and compressor temperature and thereby compressor speed for producing a valve control force in the valve arrangement that is effective to modulate the crankcase pressure so as to decrease the piston stroke above a certain compressor speed while increasing the suction pressure and maintaining acceptable displacement control at lower speeds.

* * * * *